US005259632A

United States Patent [19]

Mahoney

[11] Patent Number: 5,259,632

[45] Date of Patent: Nov. 9, 1993

[54] SKATEBOARD ADAPTED FOR USE ON ICE

[76] Inventor: Kevin T. Mahoney, 65 Weeks Rd., Apt. 5, Queensbury, N.Y. 12804

[21] Appl. No.: 834,364

[22] Filed: Feb. 12, 1992

[51] Int. Cl.[5] ..... A63C 17/18

[52] U.S. Cl. ..... 280/7.14; 280/87.042; 301/5.3; 264/262

[58] Field of Search ..... 280/87.042, 7.14, 7.13, 280/28, 11.18; 301/5.3, 5.7, 63 PW; 264/271.1, 262

[56] References Cited

U.S. PATENT DOCUMENTS

| | | | |
|---|---|---|---|
| 255,161 | 3/1882 | Gault | 280/11.18 X |
| 1,489,197 | 4/1924 | Daverkosen et al. | 280/7.13 X |
| 3,578,812 | 5/1971 | Ladue et al. | 301/63 PW |
| 3,666,322 | 5/1972 | Pickron | 301/63 PW |
| 4,043,565 | 8/1977 | Magannam | 280/11.12 |
| 4,093,249 | 6/1978 | Chambers | 280/11.18 X |
| 4,114,913 | 9/1978 | Newell et al. | 280/12 |
| 4,116,455 | 9/1978 | Dotson et al. | 280/7.12 |
| 4,130,320 | 12/1978 | Scardenzan | 301/5.7 |
| 4,208,073 | 6/1980 | Hechinger | 301/5.3 |
| 4,225,145 | 9/1980 | Carr | 280/7.14 |
| 4,521,029 | 6/1985 | Mayes | 280/7.14 |
| 4,549,742 | 10/1985 | Husak et al. | 280/11.18 |
| 4,830,807 | 5/1989 | Warren et al. | 264/262 X |
| 4,882,867 | 11/1989 | Linden | 264/271.1 X |
| 4,896,893 | 1/1990 | Shumays et al. | 280/14.2 |
| 5,129,709 | 7/1992 | Klamer | 301/5.3 |

*Primary Examiner*—Margaret A. Focarino
*Assistant Examiner*—Peter English
*Attorney, Agent, or Firm*—Ronald P. Kananen

[57] ABSTRACT

A skateboard, adapted for use on ice, utilizes a blade assembly comprised of a bushing member, a blade member and a body member. The bushing member has an outer surface and an inner surface, the inner surface defining an aperture adapted to receive the skateboard axle. The blade member has finished edges and substantially parallel faces. The body member is made of fiberglass or high strength plastic compounds and is formed such that it holds the blade member and the bushing member in a fixed relationship to one another. The body member encases a portion of the outer surface of the bushing member, allowing the bushing member to receive the axle without substantial interference. The body member also encases a portion of the substantially parallel lateral faces of the blade member, leaving a portion of the blade member exposed for contact with the ice.

16 Claims, 6 Drawing Sheets

SKATEBOARD ADAPTED FOR USE ON ICE

FIELD OF THE INVENTION

This invention relates to skateboards adapted for recreational use on ice. More particularly, this invention relates to composite blade assemblies that are used to reconfigure skateboards for use on ice.

BACKGROUND OF THE INVENTION

It is well known, in general, to provide skateboard-type structures with means for gliding on ice. For example, U.S. Pat. No. 4,043,565 describes a recreational device having an elongated board-like member for supporting the user and runner mounting means affixed in tandem to the underside of the member. Two pairs of parallel ice runners are in turn attached to the runner mounting means. Each runner has a plurality of ice contacting portions selectively positionable for contact with the ice. Suggested shapes for the runners include convexually arcuate polygon runners, circular runners, and oval shaped runners. The runners are designed in such a fashion to allow portions of the runner which have become dull to be repositioned by loosening and retightening a nut to hold an additional selected portion of a blade in contact with the ice. This allows the blade to be repositioned at any time to bring selectively different portions of the runner into contact with the ice as desired by the user.

U.S. Pat. No. 4,114,913 describes a skateboard having front and rear pairs of narrow runners or blades that enable a skateboard to be used on ice. To permit lateral movement, the edges on one pair of blades must be sharper than the edges on the other pair of blades. The blade edges are concave or angular. In all cases, the blade edges are symmetrical in cross-section. Each runner or blade is attached to a threaded stud which is in turn attached to a truck secured to the bottom of the skateboard platform.

U.S. Pat. No. 4,225,145 describes a modified skateboard having runners joined to existing trucks for use on snow or ice. Top and bottom rails of the runners are jointed and slotted to allow changing runner length upon turning. Right and left turns are achieved by shifting the weight from side to side and sliding the runners relative to the trucks. Elongated runners are curved upward at the front of the skateboard for easy turning and may be curved downward at the rear of the skateboard to provide greater stability for either straight-running or turning. The runners are symmetrical in cross-section, and are concave or have angular edges.

U.S. Pat. No. 4,521,029 discloses a skateboard adapted for use on ice which includes two pairs of skates with concave edges mounted for pivotal movement about axles which extend laterally from trucks mounted to the skateboard platform. Each skate includes an upwardly-extended protrusion which is covered by a bumper guard of resilient material for engaging the underside of the board, thereby limiting the pivotal movement of the runners and preventing the board from pitching forward and engaging the ice.

U.S. Pat. No. 4,896,893 describes a skateboard for use on ice having a pair of runner blades attached to horizontal axles which are associated with front and rear trucks attached to the skateboard platform. The runner blades either extend from axle to axle or, alternatively, auxiliary blades are attached to each side of the skateboard between the front and rear trucks and in tandem with the attached runner blades to the axles. The auxiliary blades are fixed in place and provide both added stability and the ability to turn while more weight is being exerted on one side of the deck of the skateboard. Normally the auxiliary blades are elevated and touch the ground one at a time and only as a result of weight being exerted from one side of the deck.

In view of the foregoing, it is readily apparent that the prior art devices have various drawbacks which are undesirable. For example, all of the prior art devices have blades or runners which are made almost in their entirety of steel or similar metal. Such blades or runners are constructed from metals to prevent rapid dulling and to allow resharpening of these materials with use. Moreover, the prior art blades are substantially unsupported in the lateral direction and must, therefore, be thickened to overcome this lack of support. Moreover, the positions of the blades or runners found in the prior art are fixed or otherwise restricted in their rotation or in their positioning, thereby preventing free rotation. Thus, each time the blades become dull, they must be either resharpened or, if possible, the position of the blades manually adjusted to bring a sharper portion of the blade in contact with the ice. Finally, the blade edges on prior art devices are symmetrical in cross-section which, as discussed below, is deleterious to the maneuverability of the device.

SUMMARY OF THE INVENTION

In view of the forgoing, it is an object of the present invention to overcome these and other drawbacks of the prior art. Specifically, it is one object of the present invention to provide a composite blade assembly for use on a skateboard body having metal portions in areas of greatest wear and non-metal portions elsewhere for enhanced support.

It is a further object of the present invention to provide an easily rotatable or repositionable steel blade assembly for use on a skateboard body which allows for progressive wear along the circumference of the blade and increases periods between blade sharpening.

It is a further object of the present invention to provide a blade for use on a skateboard body, wherein the edges are asymmetrical in cross-section, providing enhanced maneuverability on the ice.

It is a further object of the present invention to provide a traditional skateboard, wherein the wheels have been replaced with composite blade assemblies for use on ice.

It is a further object of the present invention to provide a simple economical means for converting any standard skateboard from its original rolling-wheeled mode to an ice gliding mode, while retaining the moveability inherent in the swivel-truck steering mechanism designed into the original skateboard.

DESCRIPTION OF THE PREFERRED EMBODIMENTS

Figure 1:
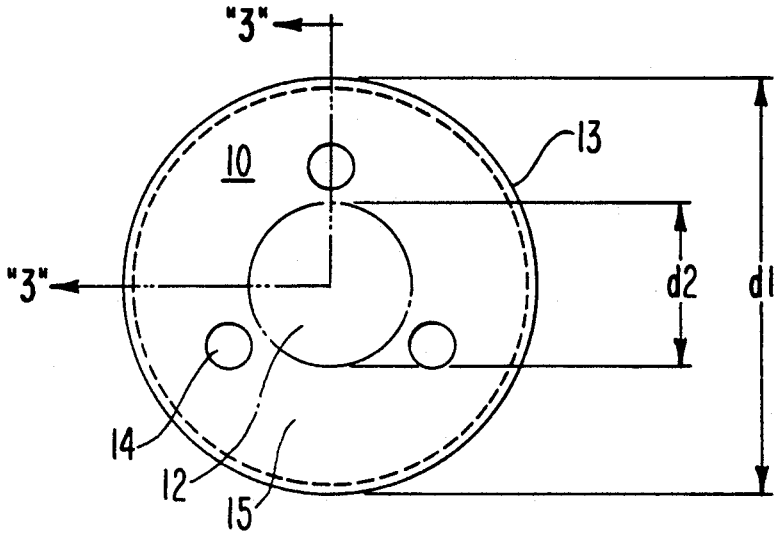
FIG. 1 is a view of the outboard face of a blade member according to one embodiment of the present invention.
Figure 2:
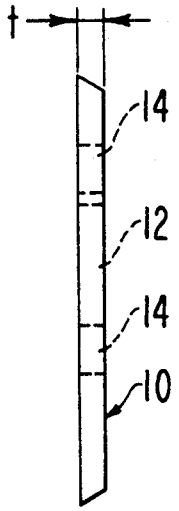
FIG. 2 is an edge view of the blade member embodiment of FIG. 1.
Figure 3:
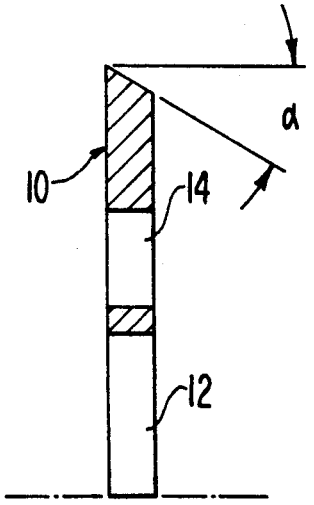
FIG. 3 is a partial sectional view taken along line "3—3" of the blade member embodiment of FIG. 1.

Referring to FIGS. 1-3, according to one embodiment of the invention, a circular blade member 10 is described having a central aperture 12 coaxial with the circumference of an outer edge 13 of the blade member 10. One or a plurality of additional offset apertures 14 are provided in an annular region 15 between the central aperture 12 and the outer edge 13 of the blade member 10.

In actual trials, it was found that the standard concave edges found on prior art ice skate blades resulted in an excessive amount of "side-slipping." Accordingly, the outer edge 13 of the blade member 10 is ground or otherwise formed to most effectively glide and maneuver on and over surfaces of frozen water and or simulated ice polymers. According to one embodiment, the outer edge of the blade member is sharpened to form a bevel having an angle $\alpha$ of about 25° to 30°. This results in a blade edge having an asymmetric cross-section with an acute angle of 60° to 65° and corresponding obtuse angle of 115° to 120°. Of course, the angle of the finished bevel of the outer edge 13 can be varied to produce optimum maneuverability. When properly ground or formed, the asymmetric cross-section of outer edge 13 of the present invention is believed to provide performance superior to standard blades having symmetric cross-sections.

While other dimensions will become readily apparent to those interested in practicing the invention, typical dimensions of various aspects of the blade member according to one embodiment are: a thickness t of about $\frac{1}{8}''$, an outer edge diameter d1 of about $2\frac{1}{4}''$, a central aperture diameter d2 of about $\frac{7}{8}''$ and one or more offset apertures 14 of about $\frac{1}{4}''$ in dimension.

While the offset apertures 14 can be placed in almost any position within the annular region 15 between the central aperture 1 and outer edge 13 of the circular blade member, one may, according to one embodiment, position one or more offset apertures 14 on a $1\frac{1}{4}''$ bolt circle. If two or more offset apertures 14 are desired, they may, but need not necessarily, be equally spaced on the bolt circle. Moreover the offset apertures 14 need not be circular, but can take on essentially any shape including ovals, polygons, slots or any regular or irregular shape.

Figure 4:
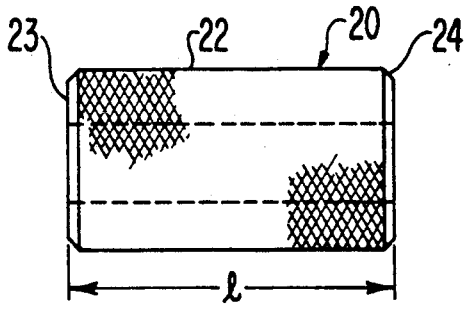
FIG. 4 is a side view of a bushing member according to one embodiment of the present invention.
Figure 5:
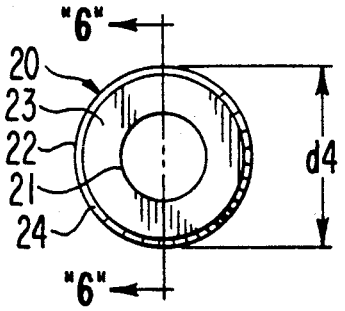
FIG. 5 is an end view of the bushing member embodiment of FIG. 4.
Figure 6:
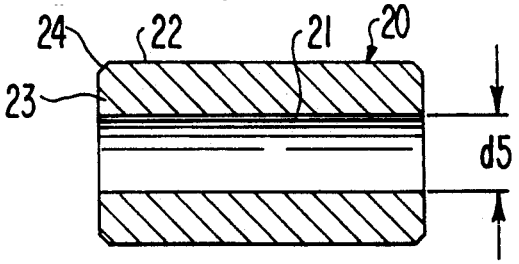
FIG. 6 is a sectional view taken along line "6—6" of the bushing member embodiment of FIG. 5.
Figure 7:
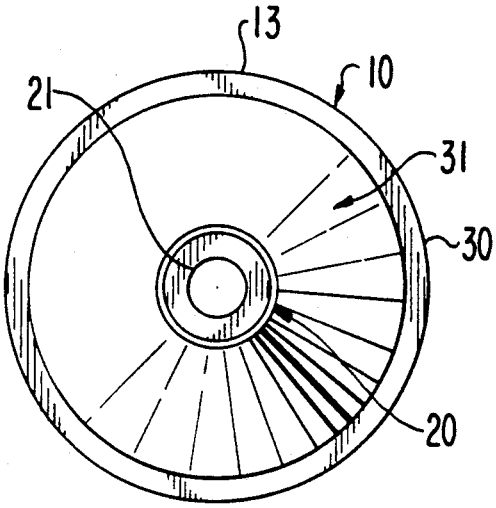
FIG. 7 is a view of the outboard face of a blade assembly according to one embodiment of the present invention.
Figure 8:
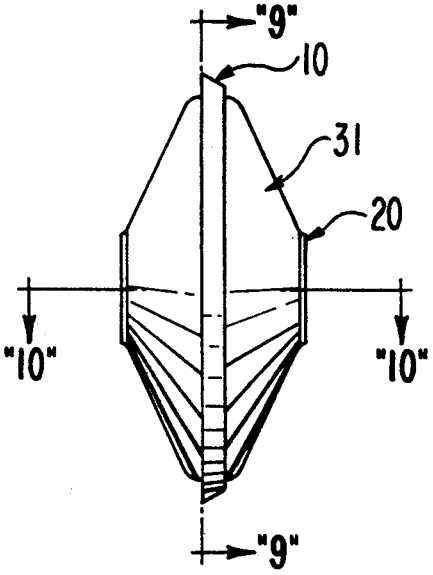
FIG. 8 is a front view of the blade assembly embodiment of FIG. 7.
Figure 9:
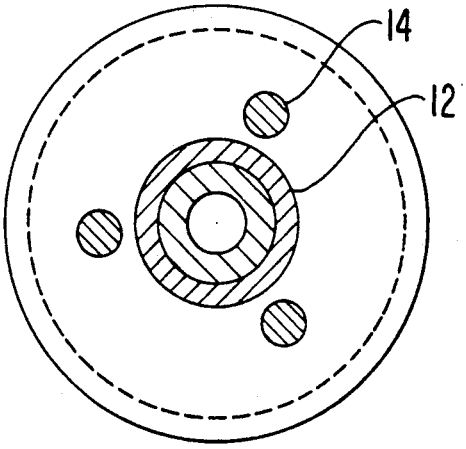
FIG. 9 is a sectional view taken along line "9—9" of the blade assembly embodiment of FIG. 8.
Figure 10:
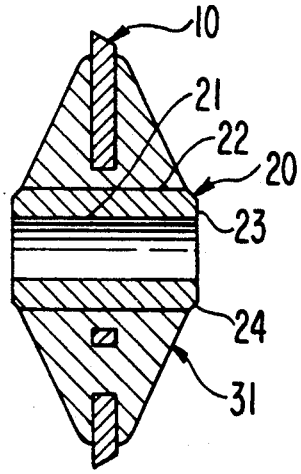
FIG. 10 is a sectional view taken along line "10—10" of the blade assembly embodiment of FIG. 8.

Referring to FIGS. 4-6, according to one embodiment, a substantially annular bushing member 20 is shown having an inner surface 21, an outer surface 22 and lateral faces 23. Note that the outer surface 22 need not be cylindrical, but can take on a variety of profiles adapted to become imbedded in the body member described below. The inner surface 21 is configured to effectively receive an axle of a standard skateboard, and is typically circular. According to one embodiment, the bushing member 20 has a deep knurl applied to its outer surface 22. The bushing member may be composed of metal or other wear-resistant material suitable for use as a bushing. In the embodiments shown, the portions where the lateral faces 23 meet the outer surface 22 (which is cylindrical) may be beveled to form chamfers 24, although this is not a strict requirement for the proper operation of the final product. All that is necessary is that the outer surface 22 of the bushing member 20 bond with the body member material described below. Typical dimensions for the bushing member 20 according to one embodiment of the present invention include an outer diameter d4 of $\frac{5}{8}''$, an inner diameter d5 of approximately 0.310" to 0.313", a length l of about 1" and a chamfer 24 of about $1/32'' \times 45°$. Of course, other dimensions will become readily apparent to those interested in practicing the present invention.

Referring to FIGS. 7-10, an embodiment of a blade assembly 30 is shown in which the bushing member 20 of FIGS. 4-6 is held in a fixed relationship with respect to the blade member 10 of FIGS. 1-3 by a body member 31. In this embodiment, an axis associated with the inner surface 21 of the bushing member 20 and an axis associated with the circumference of the outer edge 13 of the blade member 10 are substantially coaxial. Moreover, according to this embodiment, the bushing member 20 is substantially centered lengthwise within the central aperture 12 of the blade member 10. The body member 31 is constructed of fiberglass or any plastic compound capable of exhibiting suitable mechanical strength. The body member 31 substantially encases the outer surface 22 of the bushing member 20 leaving the chamfered ends 24, lateral faces 23 and the inner surface 21 of the bushing member 20 exposed. The body member 31 also substantially encases the blade member 10 while leaving the ice contacting edge 13 of the blade member 10 exposed. The body member 31 thus joins and couples the blade 10 member to the bushing member 20. The body member 31 also acts to support, reinforce and strengthen the blade assembly 30 against both vertical and lateral forces during use.

The blade assembly 30 of the present invention may be formed, according to one embodiment, by securing those portions of the blade member 10 and the bushing member 20 desired to be covered by the body member 31 within the cavity of a mold in the relative positions desired in the final product. The body member 31 is then formed by injecting fiberglass or a suitable plastic compound in a soft, uncured state into the mold under pressure. The pressure will then cause the fiberglass or plastic compound to flow such that it surrounds the outer, preferably knurled, surface 22 of the bushing member 20. Moreover, substantially all of the blade member 10, except for regions near the outer blade edge 13, which is to be left exposed, is also surrounded. The fiberglass or plastic compound will also flow through and within the offset apertures 14 in the blade member 10 and the region between the central aperture 12 of the blade member 10 and the outer surface 22 of the bushing member 20. The fiberglass or plastic is then hardened by any process appropriate for the chosen material to produce the blade assembly 30.

The outer edge of the blade member may be finish ground either before or after the molding process. This will be decided upon the final production mold design. Note that at least one offset aperture 14 is provided to allow the fiberglass or plastic to fill the aperture before hardening, further ensuring that the blade member 10 will be held within a fixed position relative to the body member 31. This end could also be achieved for example by establishing a deep knurl in the surfaces of the blade member in contact with the fiberglass or plastic compound eliminating the need for offset apertures. However, the offset apertures 14 also reinforce and increase the strength of the body member 31.

Of course, the outline curves and the thickness of the molded body member 31 can vary significantly, while retaining and supporting the relative positioning of the bushing member 20 and the blade member 10 and while not interfering with the ice contact of the blade edge 13.

Moreover, according to another embodiment of the present invention, the molded body member 31 and bushing member 20 can be replaced by metallic stock which has been formed in a way to receive the blade member 10. Holes could then be drilled to correspond with holes in the blade member 10, threaded for suitable screws and a suitable hole formed to accommodate a skateboard axle. This will eliminate the need for the knurling of the bushing member 20 and may eliminate the bushing member 20 entirely, although this may prove costly in production. This embodiment would provide the required support, but would be heavier and perhaps have mechanical characteristics less desirable than compared to the composite blade assemblies described above.

Figure 11:
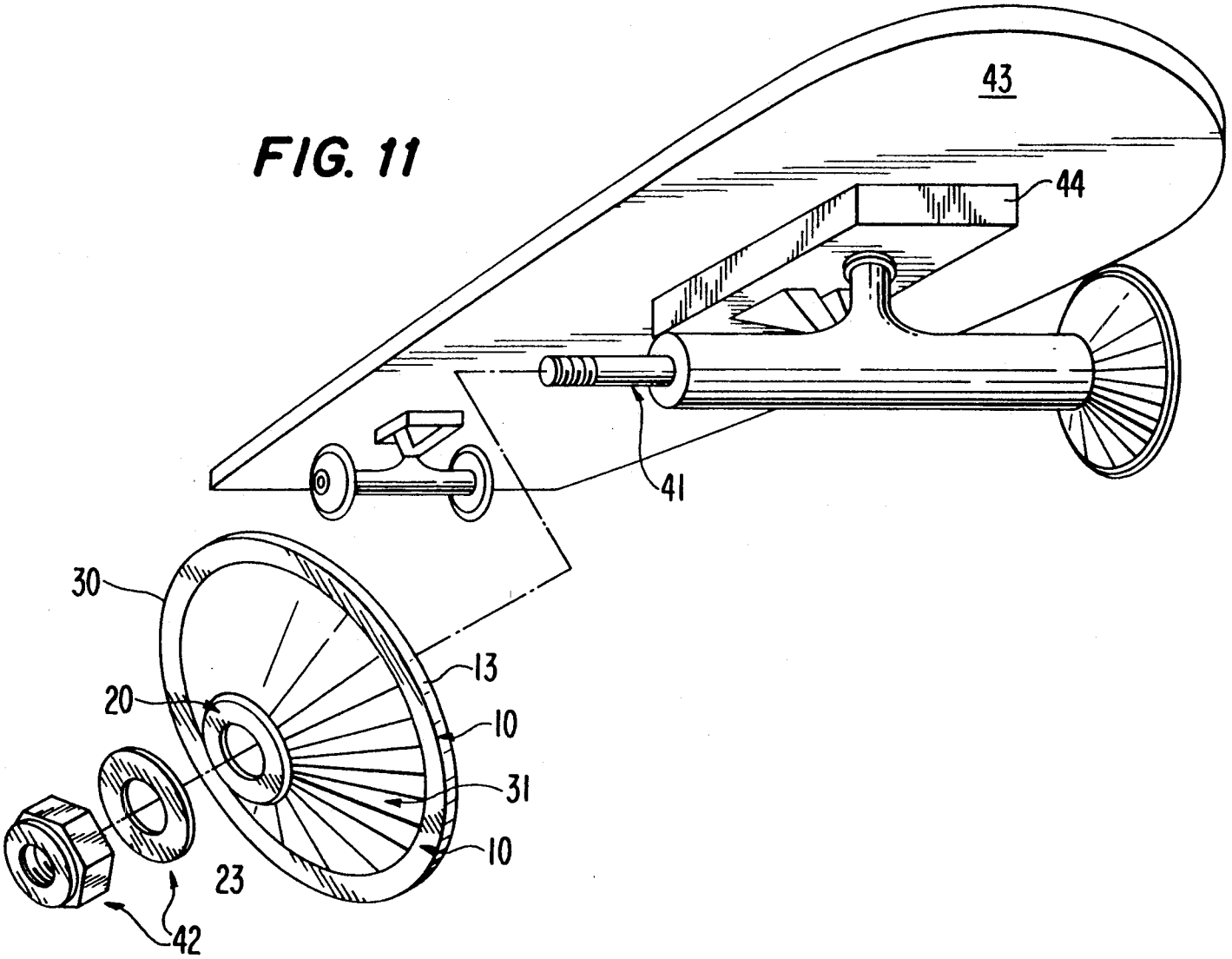
FIG. 11 is an isometric exploded assembly view of a skateboard to which a blade assembly has been mounted according to one embodiment of the invention.
Figure 12:
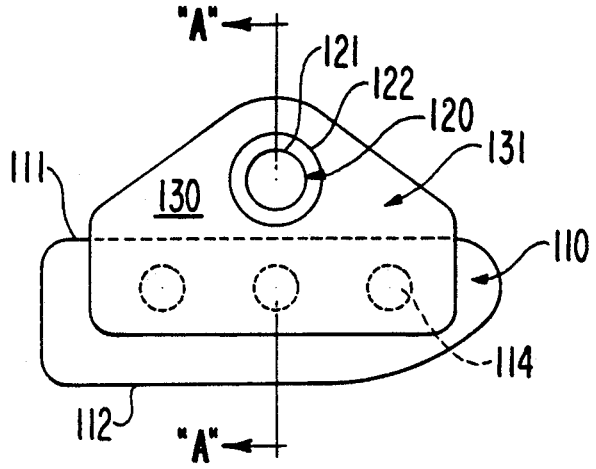
FIG. 12 is a view of the outboard face of a blade assembly according to another embodiment of the present invention.

FIG. 11 shows a typical skateboard whose wheels have been removed and replaced with the blade assemblies 30 of the present invention. The skateboard comprises a platform 43, mounting means, or trucks 44, affixed to the underside of the platform 43, and axles 41. As can be seen, the blade assembly 30 is mounted such that the bevel on the outer edge 13 of the blade member 10 faces the inboard portion of the skateboard 40. The blade assemblies 30 are secured by a standard washer-and-nut arrangement 42 which is threaded on the axle 41 to contact the lateral face 23 of the bushing member 20 on the outboard face of each of the blade assembly 30. The standard washer-and-nut arrangement may be, according to one embodiment, a standard 5/16" i.d. washer and a standard 5/16-24 U.N.F. locking nut.

FIGS. 12-16B illustrate additional embodiments of the present invention whereby an elongated blade member 110 is used.

In blade assembly 130 shown in FIGS. 12-15, an axis of the bushing member 120 is substantially parallel to an imaginary line drawn normal to either face of the substantially planar blade member 110. Moreover, according to this embodiment, the bushing member 120 is disposed above a top edge 111 of the blade member 110 and may be substantially centered with respect to the length of the blade member 110. As in the previously discussed embodiments, the body member 131 encases the outer surface 122 of the bushing member 120 leaving the chamfered ends 124 (if any) and the inner surface 121 of the bushing member exposed. The body member 131 also encloses a substantial portion of the top edge 111 of the blade member and a substantial portion of the faces of the blade member 110, leaving the ice contacting lower edge 112 of the blade member 110 exposed. As with the previous embodiments, apertures 114 may be provided in the blade member to improve the performance of the blade assembly.

Figure 13:
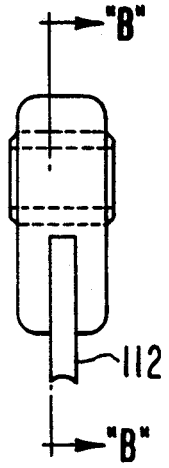
FIG. 13 is a front view of the blade assembly embodiment of FIG. 12.
Figure 14:
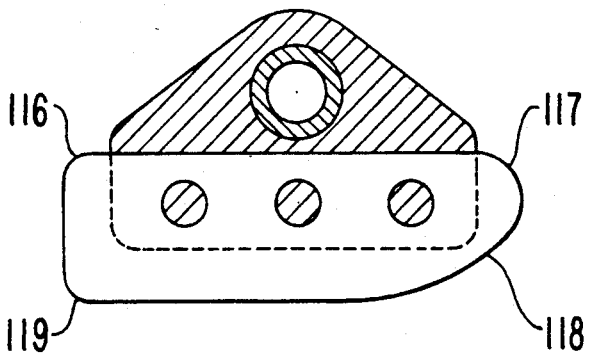
FIG. 14 is a sectional view taken along line "b—b" of the blade assembly embodiment of FIG. 13.
Figure 15:
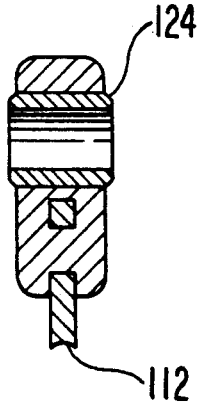
FIG. 15 is a sectional view taken along line "a—a" of the blade assembly embodiment of FIG. 12.
Figure 16:
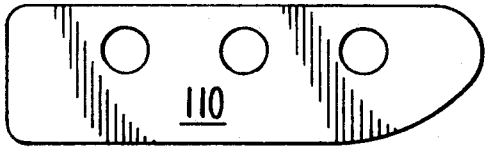
FIG. 16 is a view of the outboard face of the blade member in the embodiments of FIGS. 12-15.
Figure 16B:
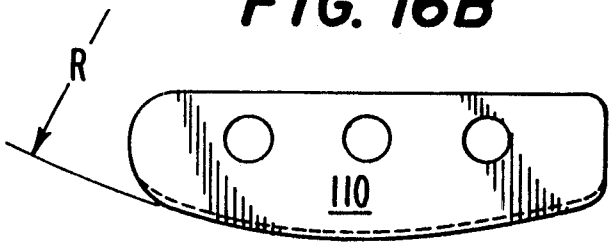
FIGS. 16A and 16B are views of the outboard faces of left and right blade members according to another embodiment of the patent invention.
Figure 16A:
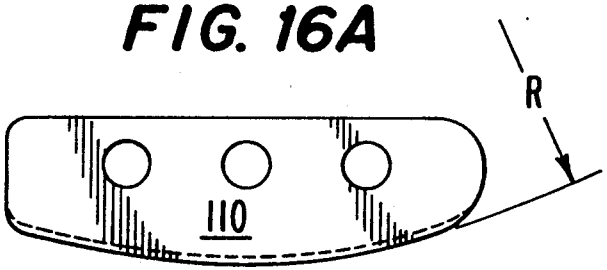

According to one embodiment, the blade member 110 has a length of about 2½", a width of about ¾", a thickness of about ⅛" and contains one or more apertures 114. For example, the embodiment may comprise three apertures 114 spaced about ⅝" apart and having center spaced about ¼" from the top edge 111 along the length of the blade member 110. The corners 116, 117, 118 and 119 of the blade member 110 are rounded to the extent desired. The lower edge 112 may be linear as shown in FIGS. 12-15 or may be rounded based on the radius of R of a large circle, as shown in FIGS. 16A and 16B. Note that the lower edge 112 may be concave in cross-section as is shown in FIG. 13 or may be asymmetrically beveled as shown in FIG. 15. Of course, other dimensions will become readily apparent to those practicing the invention.

The embodiment shown in FIGS. 12-16B may suffer minor drawbacks when compared to the embodiments of FIGS. 1-10. For example, the long-bladed embodiment may result in axial rotation while used in aerial stunts, resulting in a decrease in effective blade-to-ice contact. This effect is eliminated by the use of the round-blade embodiment. Nonetheless, under certain applications or differing ice conditions, the long-bladed version may provide performance superior to that of the round-bladed embodiment.

While the above description and accompanying drawings and text contain certain specificities, these should not be construed as limitations on the scope of the invention rather as an exemplification of the basic and preferred embodiment thereof. Variations are possible. Many changes can take place while retaining the relative positioning of functions of the ice-gliding blade and the axle-mounting means. Accordingly, the scope of the invention should be determined by the above and the following claims and their legal equivalent.

I claim:

1. A blade assembly for mounting on an axle of a standard skateboard comprising:

a bushing member having an outer surface and an inner surface, said inner surface defining an aperture adapted to receive a skateboard axle;

a blade member having an asymmetrical shaped sharp edge and substantially parallel lateral faces; and a body member composed of a material selected from the group consisting of fiberglass and high-strength plastic compounds, said body member holding said blade member and said bushing member in a fixed relationship with respect to one another, encasing a portion of the outer surface of said bushing member such that said bushing member receives said axle without substantial interference between said axle and said body member, and encasing a portion of said two substantially parallel lateral faces of said blade member such that portions of said two substantially parallel lateral faces of said blade member remain exposed and so that said sharp edge projects beyond said body member, wherein said blade member is substantially circular, and said bushing member is fixed in a central aperture in said blade member such that an axis of said inner surface of said bushing member and an axis of an outer circumference of said circular blade member are substantially coaxial.

2. The blade assembly of claim 1, wherein said ember has at least one aperture formed in a region of said blade member between said central aperture and said outer circumference and wherein said body member encases and extends through said aperture.

3. The blade assembly of claim 1, wherein at least one aperture is formed in said lateral face of said blade member, said body member encasing and extending through said aperture.

4. The blade assembly of claim 1, wherein said sharp edge is asymmetrical in cross-section.

5. The blade assembly of claim 1, wherein said sharp edge is beveled such that said edge comprises obtuse and acute angles when viewed in cross-section.

6. The blade assembly of claim 5, wherein said acute angle ranges from about 60° to 65°.

7. A blade assembly for mounting on an axle of a standard skateboard comprising:

a bushing member having an outer surface and an inner surface, said inner surface defining an aperture adapted to receive a skateboard axle;

a blade member having an asymmetrical shaped sharp edge and substantially parallel lateral faces; and a body member composed of a material selected from the group consisting of fiberglass and high-strength plastic compounds, said body member holding said blade member and said bushing member in a fixed relationship with respect to one another, encasing a portion of the outer surface of said bushing member such that said bushing member receives said axle without substantial interference between said axle and said body member, and encasing a portion of said two substantially parallel lateral faces of said blade member such that portions of said two substantially parallel lateral faces of said blade member remain exposed and so that said sharp edge projects beyond said body member, wherein said blade member is elongated having an upper surface defined by a flat upper edge extending parallel to a flat plane of a skateboard for the entire length of said upper surface, said bushing member being fixed in a position above an upper edge of said blade member and an axis of said inner surface of said bushing member is substantially parallel to an imaginary line drawn normal to said lateral faces of said blade member.

8. A skateboard for use on ice comprising a platform, an axle, mounting means for coupling said axle to said platform and a blade assembly, said blade assembly further comprising:

a bushing member having an outer surface and inner surface, said inner surface defining an aperture adapted to receive said skateboard axle;

a blade member having a sharp edge and substantially parallel lateral faces;

a body member composed of a material selected from the group consisting of fiberglass and high-strength plastic compounds, said body member holding said blade member and said bushing member in a fixed relationship with respect to one another, encasing a portion of the outer surface of said bushing member such that said bushing member receives said axle without interference between said axle and said body member, and encasing a portion of said two substantially parallel lateral faces of said blade member such that portions of said two substantially parallel lateral faces of said blade member, including said sharp edge, remain exposed for contact with said ice; and wherein said blade member is substantially circular, and said bushing member is fixed in a central aperture in said blade member such that an axis of said inner surface of said bushing member and an axis of an outer circumference of said circular blade member are substantially coaxial.

9. The skateboard of claim 8, wherein said blade member has at least one aperture formed in a region of said blade member between said central aperture and said outer circumference and wherein said body member encases and extends through said aperture.

10. The skateboard of claim 8, wherein said blade member is substantially elongated, said bushing member is fixed in a position above an upper edge of said blade member and an axis of said inner surface of said bushing member is substantially parallel to an imaginary line drawn normal to said lateral faces of said blade member.

11. The skateboard of claim 8, wherein at least one aperture is formed in said lateral face of said blade member, said body member encasing and extending through said aperture.

12. The skateboard of claim 8, wherein said sharp edge is asymmetrical in cross-section.

13. The skateboard of claim 8, wherein said sharp edge is beveled such that said edge comprises obtuse and acute angles when viewed in cross-section.

14. The skateboard of claim 13, wherein said acute angle ranges from about 60° to 65°.

15. A method of forming a blade assembly for mounting on the axle of a standard skateboard comprising the steps of:

making an elongated blade member by forming a flat upper surface extending the entire length of the blade member, forming a lower ice engaging surface and forming curved end surfaces extending between the upper and lower surfaces;

obtaining a bushing member and a molding compound selected from the group consisting of fiberglass and plastic, said molding compound capable of being injected and hardened;

exposing portions of said blade member and said bushing member intended to be encased by said compound in a mold cavity, said blade member and said bushing member being fixed in a desired relationship in said mold cavity;

injecting said molding compound in a soft uncured state into said mold cavity under pressure; and hardening said molding compound.

16. A method of forming a blade assembly for mounting on the axle of a standard skateboard comprising the steps of:

making a circular blade member by forming a circular outer ice engaging surface and forming a central aperture coaxial with the circular outer surface;

obtaining a bushing member and a molding compound selected from the group consisting of fiberglass and plastic, said molding compound capable of being injected and hardened;

exposing portions of said blade member and said bushing member intended to be encased by said compound in a mold cavity, said blade member and said bushing member being fixed in a desired relationship in said mold cavity;

injecting said molding compound in a soft uncured state into said mold cavity under pressure; and hardening said molding compound.

* * * * *